US011629553B2

(12) United States Patent
Morton, III et al.

(10) Patent No.: US 11,629,553 B2
(45) Date of Patent: Apr. 18, 2023

(54) GATE

(71) Applicants: Finis Earl Morton, III, Millington, TN (US); Arty Lindley, Atoka, TN (US)

(72) Inventors: Finis Earl Morton, III, Millington, TN (US); Arty Lindley, Atoka, TN (US)

( * ) Notice: Subject to any disclaimer, the term of this patent is extended or adjusted under 35 U.S.C. 154(b) by 52 days.

(21) Appl. No.: 16/912,467

(22) Filed: Jun. 25, 2020

(65) Prior Publication Data

US 2021/0404255 A1 Dec. 30, 2021

(51) Int. Cl.
*E06B 11/02* (2006.01)
*E06B 9/01* (2006.01)

(52) U.S. Cl.
CPC ..... *E06B 11/022* (2013.01); *E06B 9/01* (2013.01); *E06B 11/027* (2013.01)

(58) Field of Classification Search
CPC ..... E06B 11/022; E06B 11/027; E06B 11/02; E06B 9/01
See application file for complete search history.

(56) References Cited

U.S. PATENT DOCUMENTS 2,245,826 A * 6/1941 Rowe ..... E06B 11/02 256/73
3,740,897 A * 6/1973 Johns ..... E06B 11/02 49/381
3,997,144 A * 12/1976 Parisien ..... E04H 17/163 256/32
4,132,390 A * 1/1979 Pfarr, Jr. ..... E04H 17/066 160/392
4,682,761 A * 7/1987 Hanneken ..... E04H 17/22 256/36
5,356,101 A * 10/1994 Malloy ..... E04H 12/2215 248/156
5,593,141 A 1/1997 Cain
5,595,370 A * 1/1997 Heck ..... A01K 15/04 256/14
5,716,041 A * 2/1998 Groves ..... E06B 11/02 256/24
5,868,382 A * 2/1999 Groves ..... E06B 11/02 256/73
6,010,117 A 1/2000 Doxey
6,085,481 A * 7/2000 Lee ..... E06B 9/01 49/501
6,464,209 B2 10/2002 Meis et al.
6,715,736 B2 * 4/2004 Cummings ..... E04H 17/1439 256/24
7,121,531 B1 * 10/2006 Gonzalez ..... E05B 17/2084 256/73

(Continued)

FOREIGN PATENT DOCUMENTS

CA 2306197 A1 * 10/2001 ..... E05D 5/06
CA 2406698 A1 * 11/2003 ..... E06B 3/984

(Continued)

*Primary Examiner* — Marcus Menezes
(74) *Attorney, Agent, or Firm* — David J. Kreher

(57) ABSTRACT

A gate made from light weight tubular material with creates a framework upon which slats are attached. Slats are capable of being attached on the front of the gate or being passed through slots in the tubular material. The framework is capable of being reinforced with the use of additional tubular material or braces in the corners, as well as additional horizontal, vertical, or diagonal supports.

2 Claims, 12 Drawing Sheets

(56) References Cited

U.S. PATENT DOCUMENTS

| | | | | |
|---|---|---|---|---|
| 7,134,646 | B1 * | 11/2006 | Brooks | E04H 17/143 256/65.02 |
| 7,237,766 | B2 * | 7/2007 | Lemay | E04H 17/066 256/1 |
| 7,500,655 | B1 * | 3/2009 | Smith | E06B 11/02 256/27 |
| 8,382,070 | B1 * | 2/2013 | Gibbs | E04H 17/143 256/65.02 |
| 8,646,756 | B2 | 2/2014 | Mann | |
| 9,366,055 | B1 * | 6/2016 | Wright | E06B 11/02 |
| 9,512,674 | B2 * | 12/2016 | Keudell | E06B 11/022 |
| 9,982,479 | B1 * | 5/2018 | Flannery | E06B 9/02 |
| 10,202,804 | B2 | 2/2019 | Prasad | |
| 10,415,308 | B1 * | 9/2019 | Penhallegon | E06B 11/022 |
| 10,458,180 | B2 * | 10/2019 | Wright | E06B 11/02 |
| 11,066,874 | B1 * | 7/2021 | Penner | E06B 11/022 |
| 2002/0023406 | A1 * | 2/2002 | Pettit | E04H 17/1417 52/832 |
| 2003/0217515 | A1 * | 11/2003 | Boroviak | E05D 5/06 49/501 |
| 2004/0129848 | A1 * | 7/2004 | Boroviak | E06B 11/04 248/247 |
| 2006/0255325 | A1 * | 11/2006 | Lo | E04H 17/1417 256/59 |
| 2011/0024060 | A1 * | 2/2011 | Brownbill | E04H 17/168 160/188 |
| 2012/0217460 | A1 * | 8/2012 | Bugh | E06B 11/02 256/73 |
| 2016/0108668 | A1 * | 4/2016 | Volin | E06B 11/02 256/73 |
| 2016/0230413 | A1 * | 8/2016 | Springborn | E04H 17/1417 |
| 2016/0244992 | A1 * | 8/2016 | Presti | E04H 17/1447 |
| 2016/0251897 | A1 * | 9/2016 | Keudell | E04H 17/1426 256/26 |
| 2016/0376822 | A1 * | 12/2016 | Volin | E05D 11/00 49/396 |
| 2017/0247944 | A1 * | 8/2017 | Ramsey | E06B 11/022 |
| 2017/0321460 | A1 * | 11/2017 | Siebert | E05B 15/0093 |
| 2019/0071891 | A1 * | 3/2019 | Lebrija | E04H 17/1417 |
| 2019/0177997 | A1 * | 6/2019 | Springborn | E04H 17/1417 |

FOREIGN PATENT DOCUMENTS

| | | | | |
|---|---|---|---|---|
| CA | 2445165 | A1 * | 4/2005 | E06B 3/7003 |
| FR | 2538026 | A1 * | 6/1984 | E06B 11/02 |
| GB | 2174135 | A * | 10/1986 | E06B 11/02 |
| GB | 2189283 | A * | 10/1987 | E06B 11/02 |
| GB | 2322398 | A * | 8/1998 | E06B 11/02 |
| GB | 2385082 | A * | 8/2003 | E04F 11/1812 |
| GB | 2390104 | A * | 12/2003 | E04H 17/165 |
| GB | 2408064 | A * | 5/2005 | E06B 11/02 |
| GB | 2569361 | A * | 6/2019 | E06B 11/02 |
| WO | WO-2016022022 | A1 * | 2/2016 | E06B 11/02 |

* cited by examiner

GATE

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC

Not Applicable

DESCRIPTION

Field of the Invention

The present disclosure reveals a gate with a rectangular tubing structure upon with slats are attached.

Background of the Invention

Gates for fences, in particular, wooden or wood like fences with vertical or horizontal slats are hung from posts with a plurality of hinges and over time sag, warp, or drag on the ground. To overcome the sagging and warping, additional trusses are added, which make the gate heavy, placing extra stress on the hinges, pulling the gate and/or fence post down, which can then lead to the gate dragging on the ground. The present disclosure reveals a gate with a light weight rectangular tubing structure upon with slats are attached. The rectangular tubing is light weight and the wall thickness of the rectangular tubing is thin enough so that slats can be attached structure with the use of self-tapping screws in a fashion common to the industry.

SUMMARY OF THE INVENTION

The present disclosure reveals a gate with a framework, a plurality of slats, and a plurality of hinges. The framework is a light weight framework made from rectangular tubular material wherein the walls of the rectangular tubular material is thin enough so that a self-tapping screw can be drilled into any wall of the rectangular tubular material in a fashion common to the industry. The tubular material for the framework may also be of another geometric shape so long as the front face and the back face of the tubular material is parallel.

The slats can be attached to the front of the framework or pass through the rectangular tubing through slots created in the tubing. The slats are then able to be presented in a horizontal, vertical, or diagonal pattern.

The structural integrity of the framework may be reinforced in the corners of the framework with additional rectangular tubing or braces. The structural integrity of the framework may also be reinforced with the use of horizontal, vertical or diagonal supports.

The gate may further comprise a latch to maintain the gate in a closed position.

BRIEF DESCRIPTION OF THE SEVERAL VIEWS OF THE DRAWING

FIG. 8C is a view of the framework with diagonal support; and.

AMENDED DETAILED DESCRIPTION OF THE INVENTION

Figure 1:
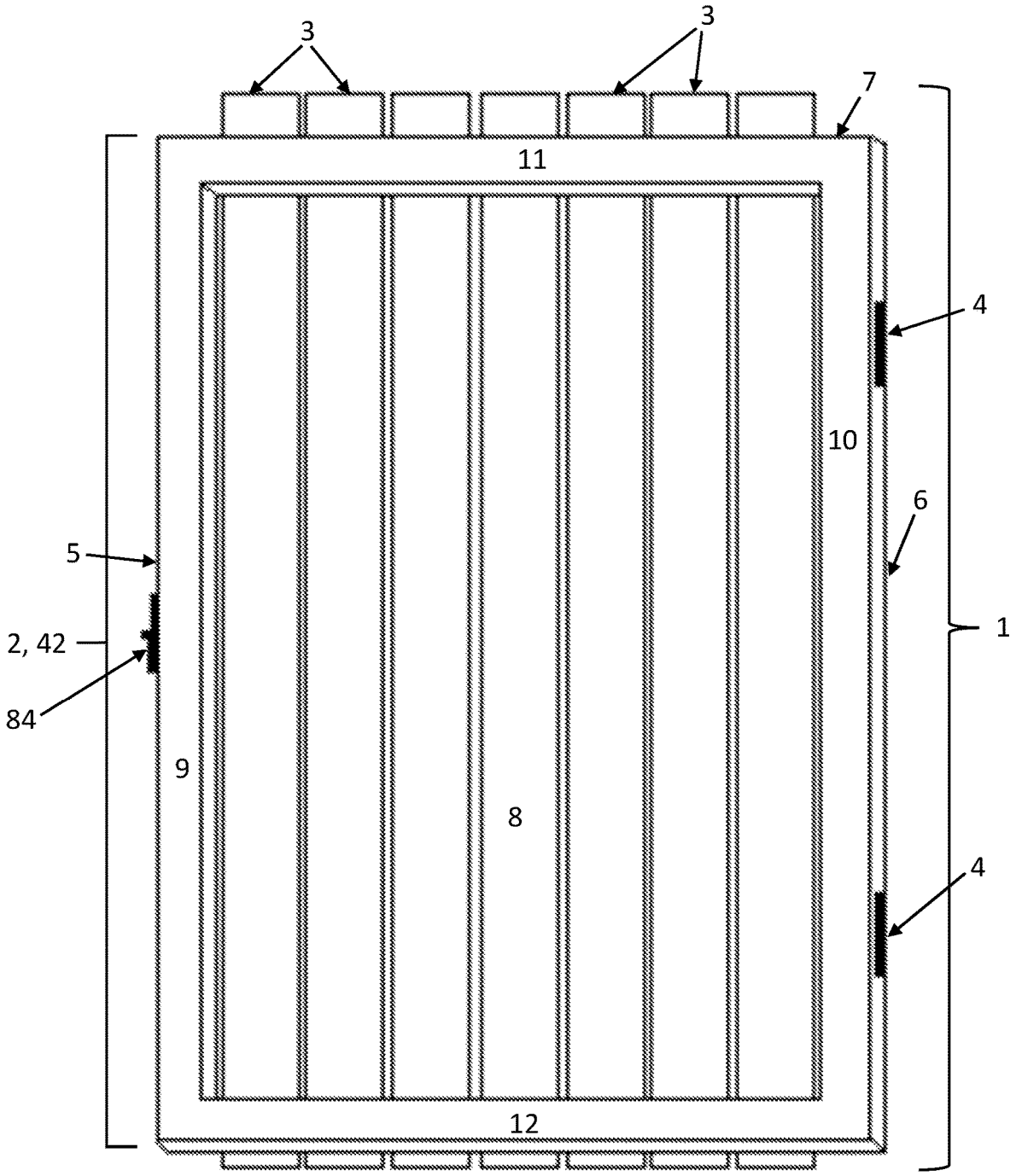
FIG. 1 is a view of the gate with the framework and a plurality of slats, the first embodiment.
Figure 2:
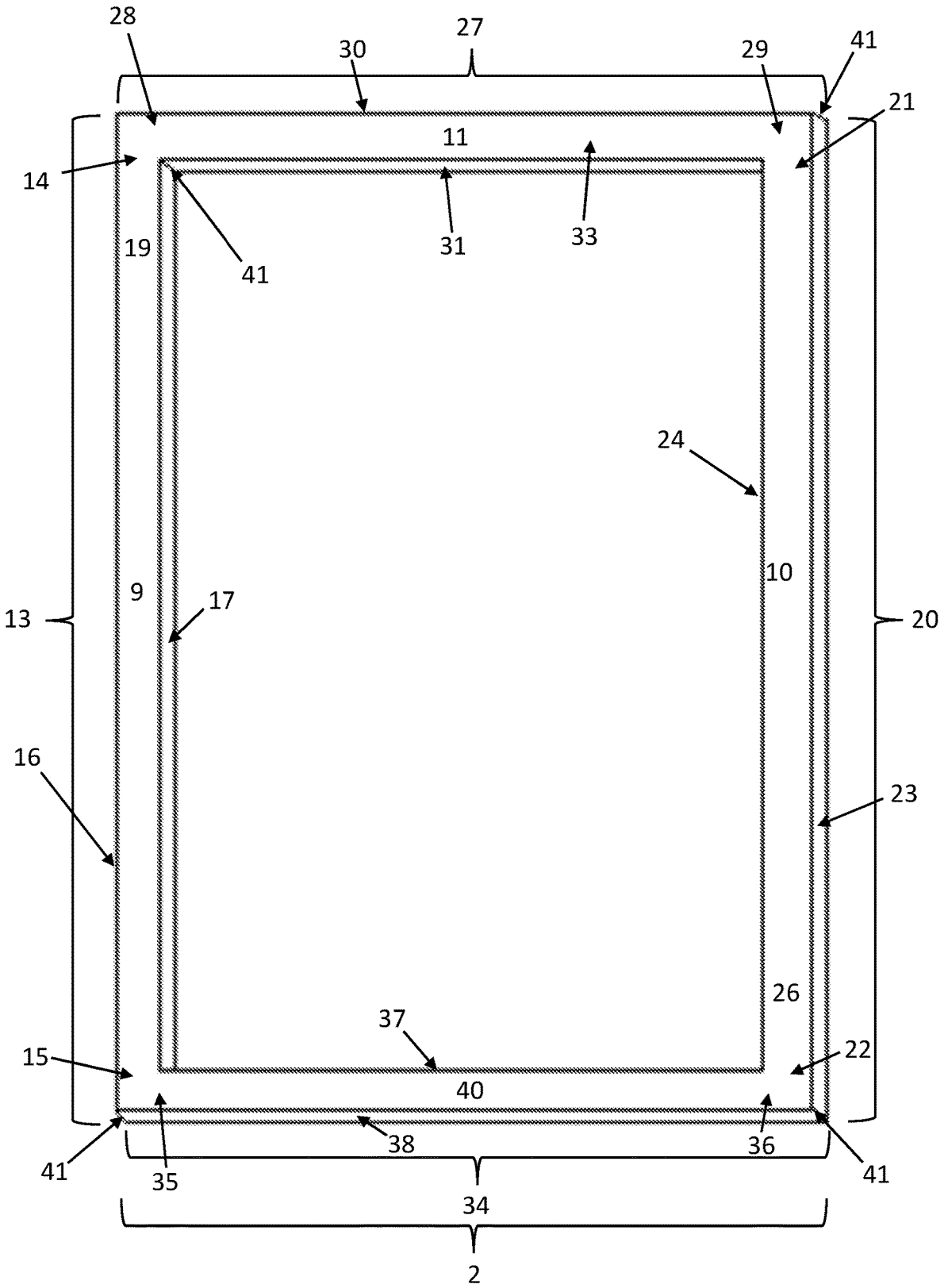
FIG. 2 is a view of the framework used in each embodiment.
Figure 3:
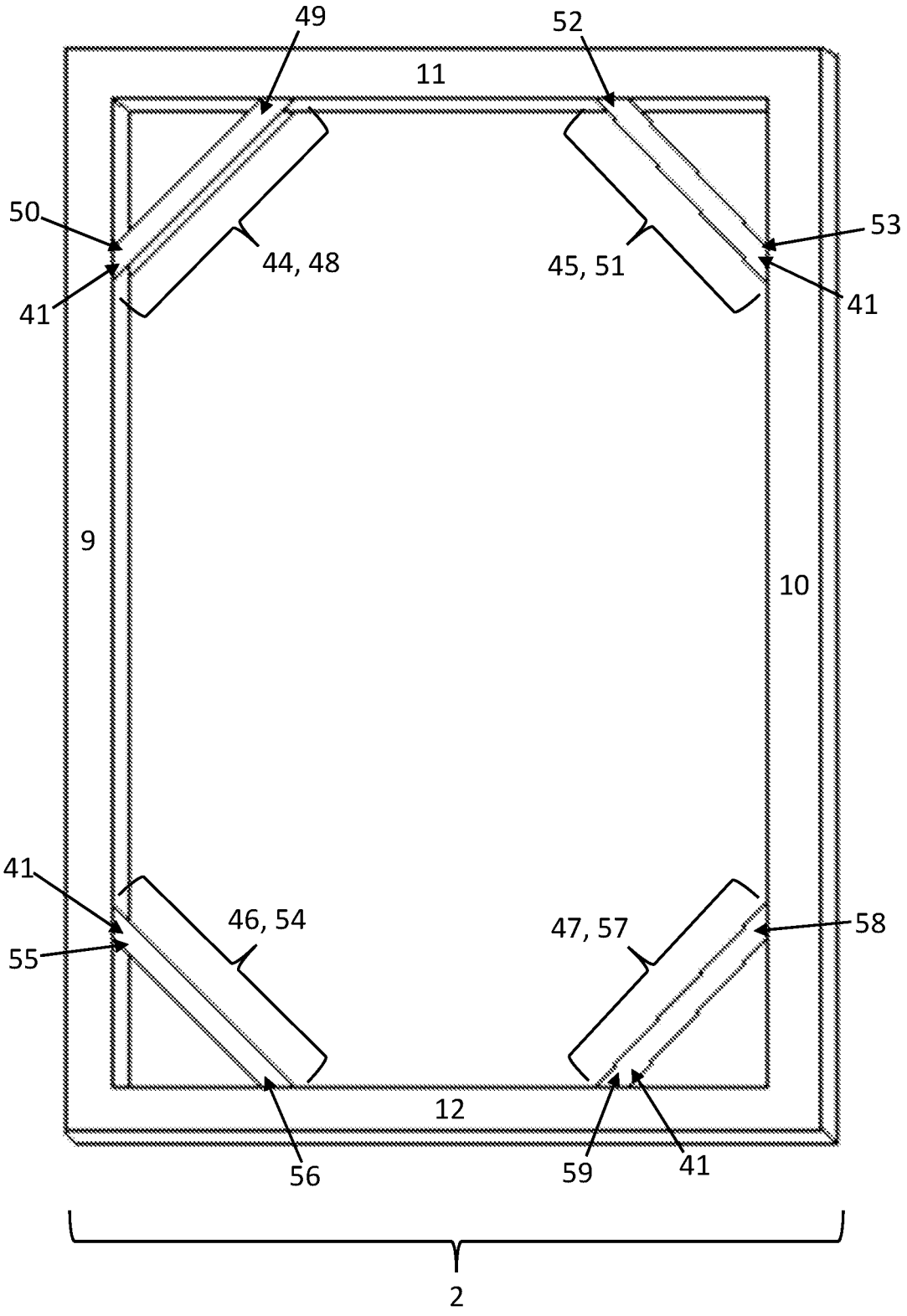
FIG. 3 is a view of the first embodiment of the gate with the framework, the upper left rectangular tubing, upper right rectangular tubing, bottom left rectangular tubing, and bottom right rectangular tubing.
Figure 4A:
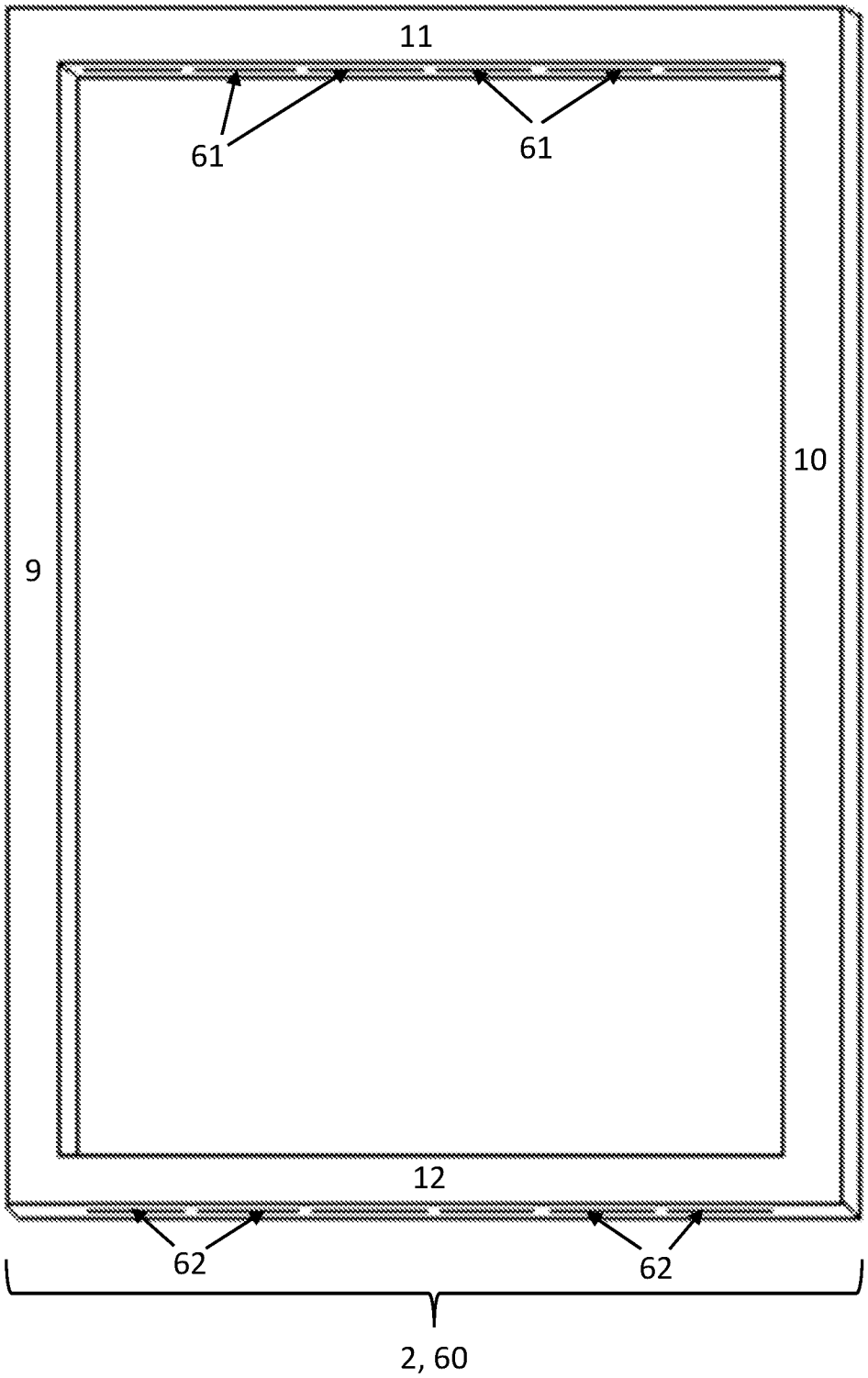
FIG. 4A is a back view of the framework for the second embodiment indicating a plurality of slots in the upper rectangular tubing and a plurality of slots in the lower rectangular tubing.
Figure 4B:
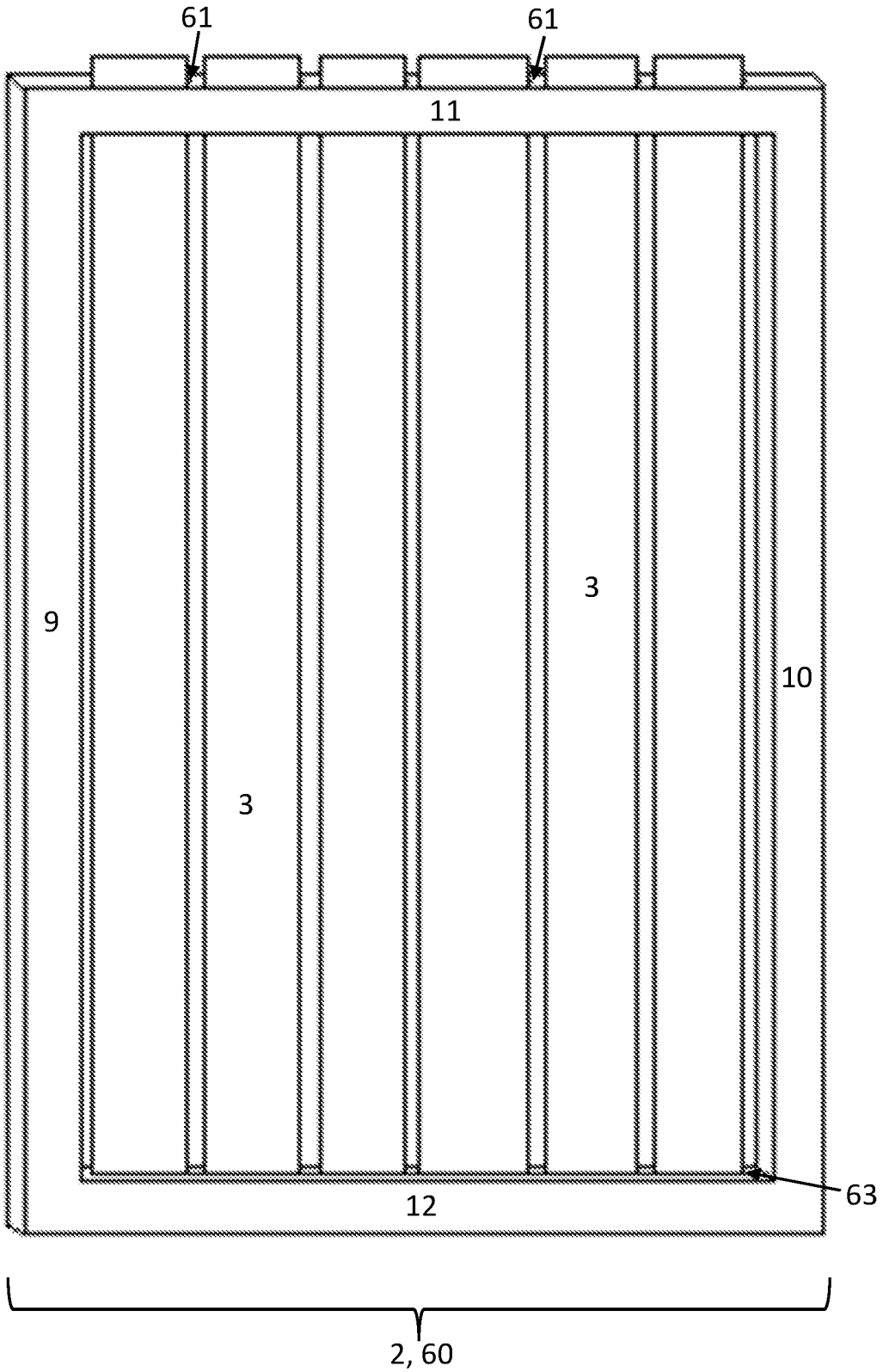
FIG. 4B is a back view of the framework for the second embodiment indicating a plurality of slots in the upper rectangular tubing and a trough in the lower rectangular tubing.
Figure 5:
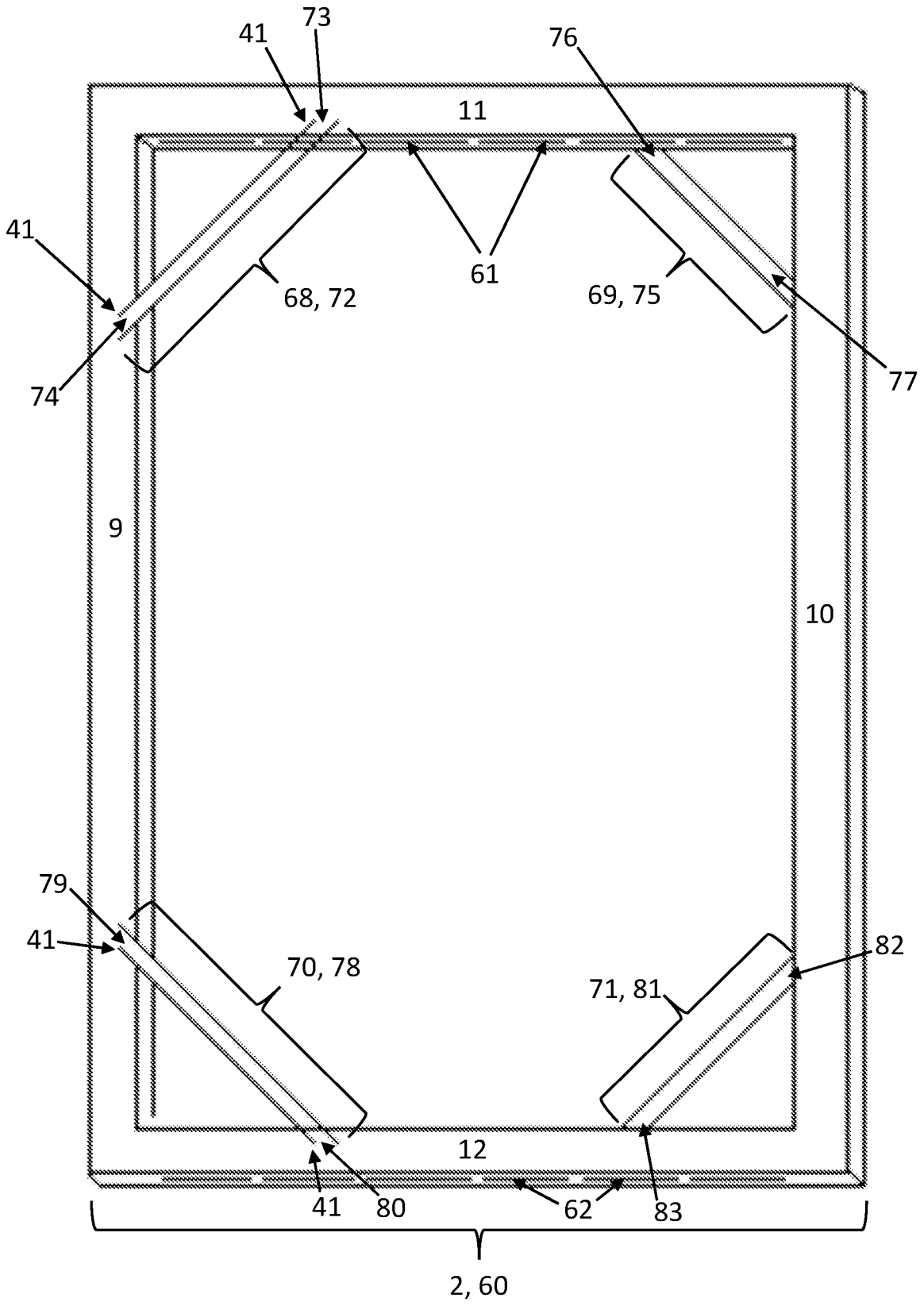
FIG. 5 is a view of the framework with the plurality of upper left braces, plurality of upper right braces, plurality of lower left braces, and plurality of lower right braces.
Figure 6:
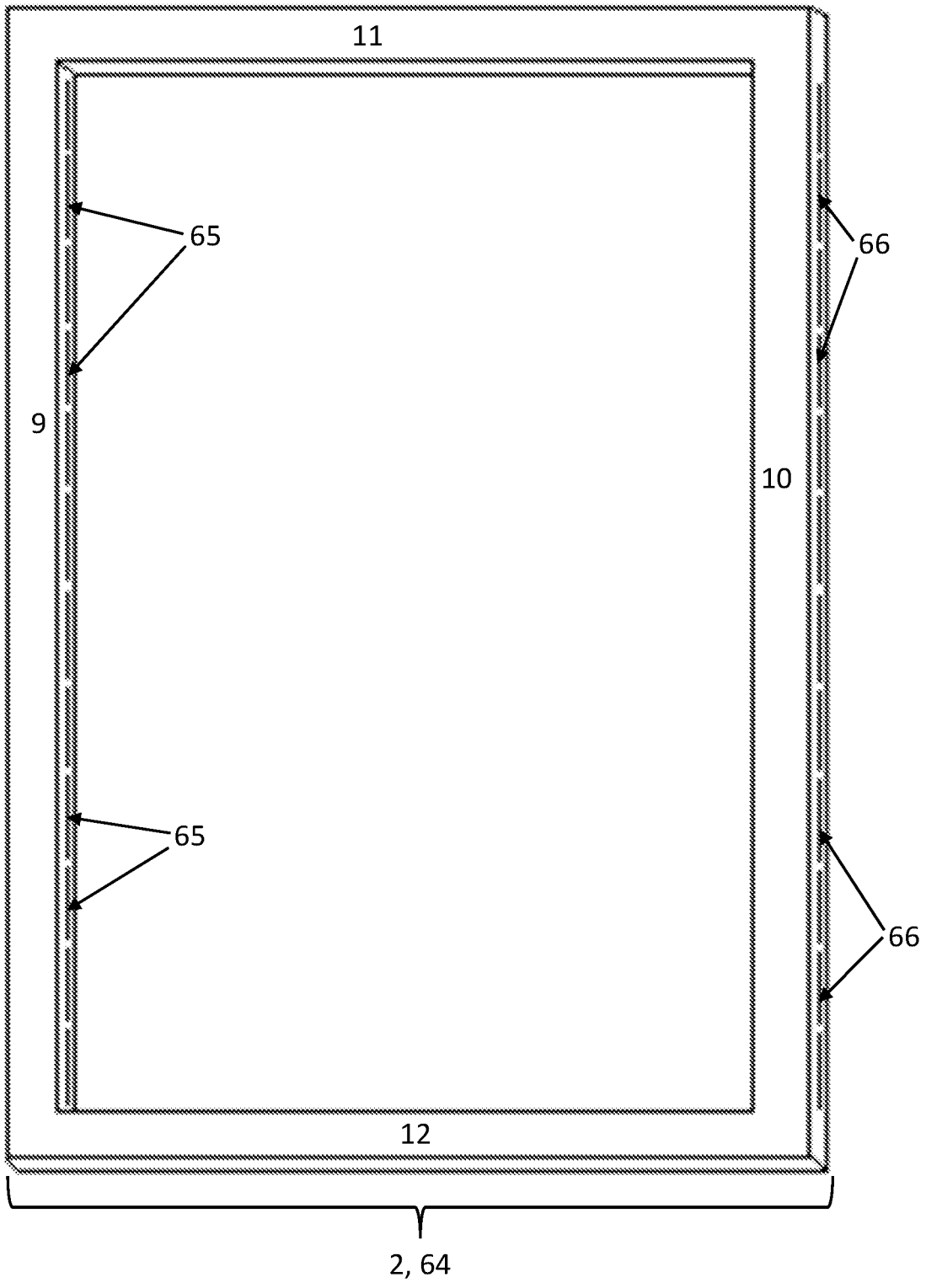
FIG. 6 is a back view of the third embodiment indicating a plurality of slots in the left rectangular tubing and a plurality of slots in the right rectangular tubing.
Figure 7:
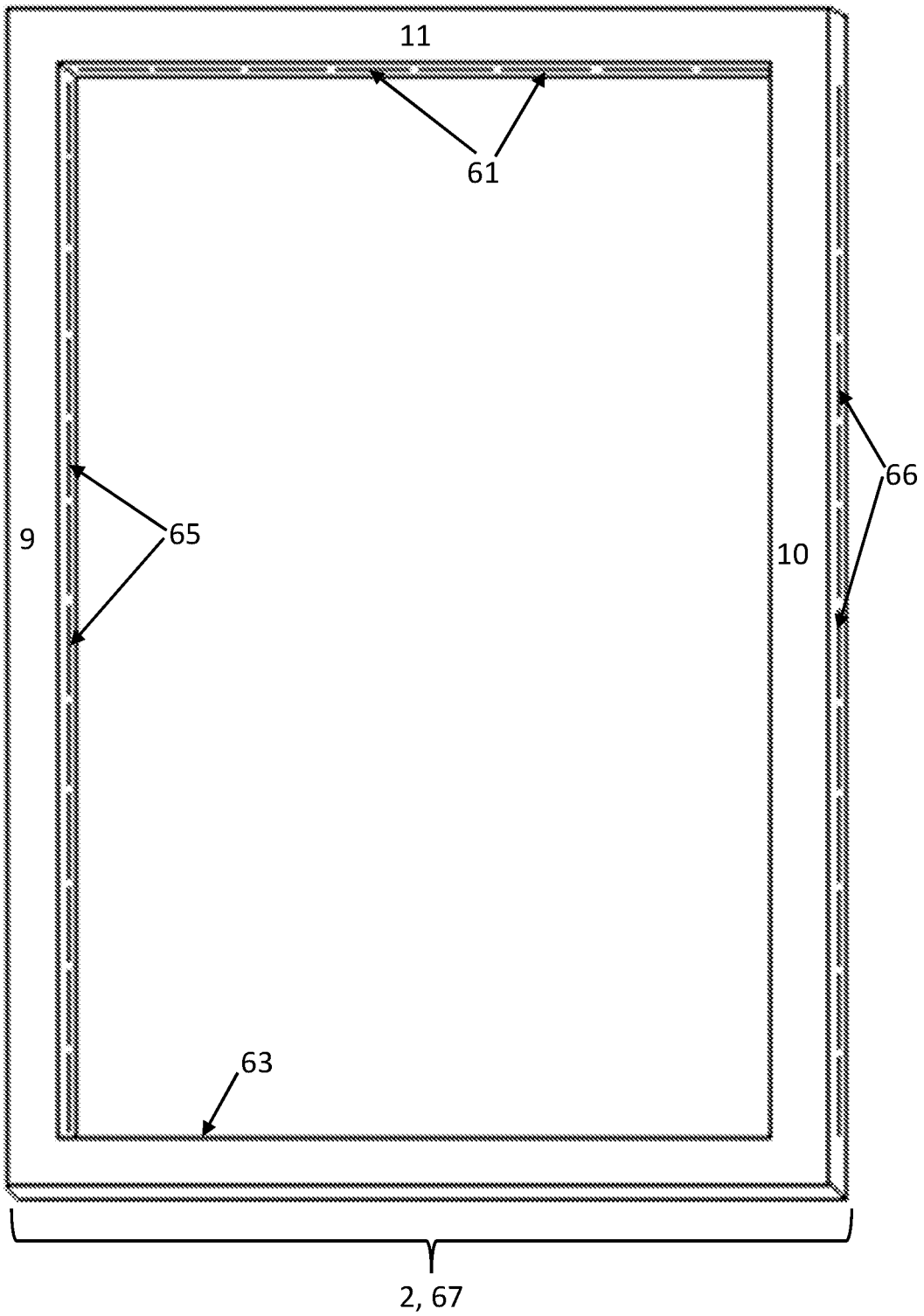
FIG. 7 is a back view of the fourth embodiment of the gate wherein the plurality of slots are in the left rectangular tubing, right rectangular tubing, top rectangular tubing, and bottom rectangular tubing, allowing the slats to be inserted diagonally.
Figure 8A:
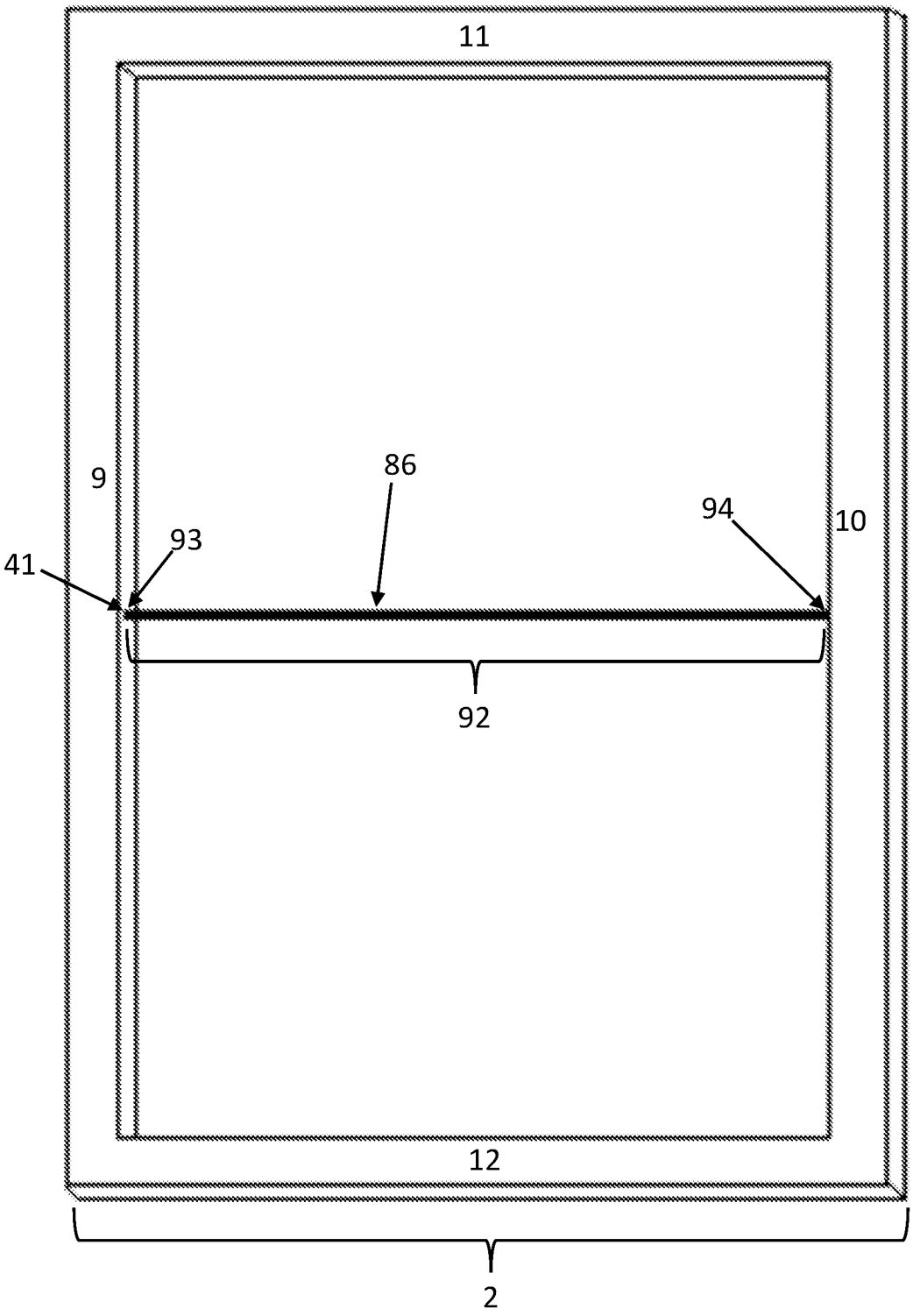
FIG. 8A is a view of the framework with horizontal support.
Figure 8B:
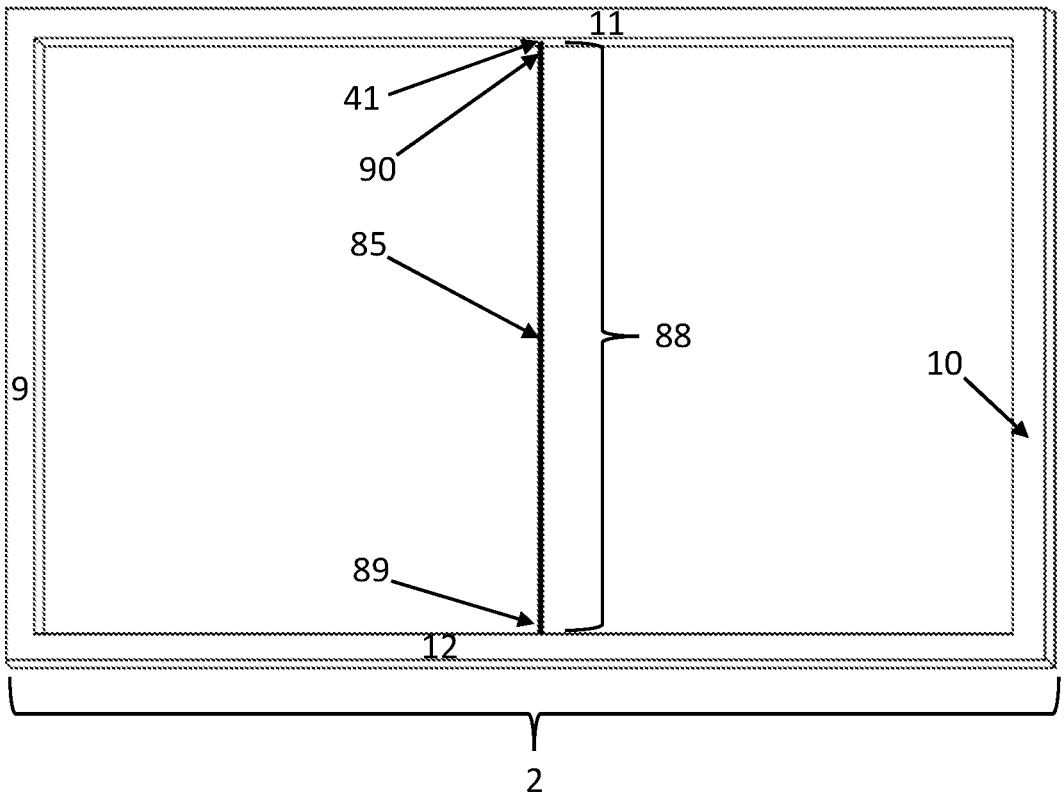
FIG. 8B is a view of the framework with vertical support.
Figure 8C:
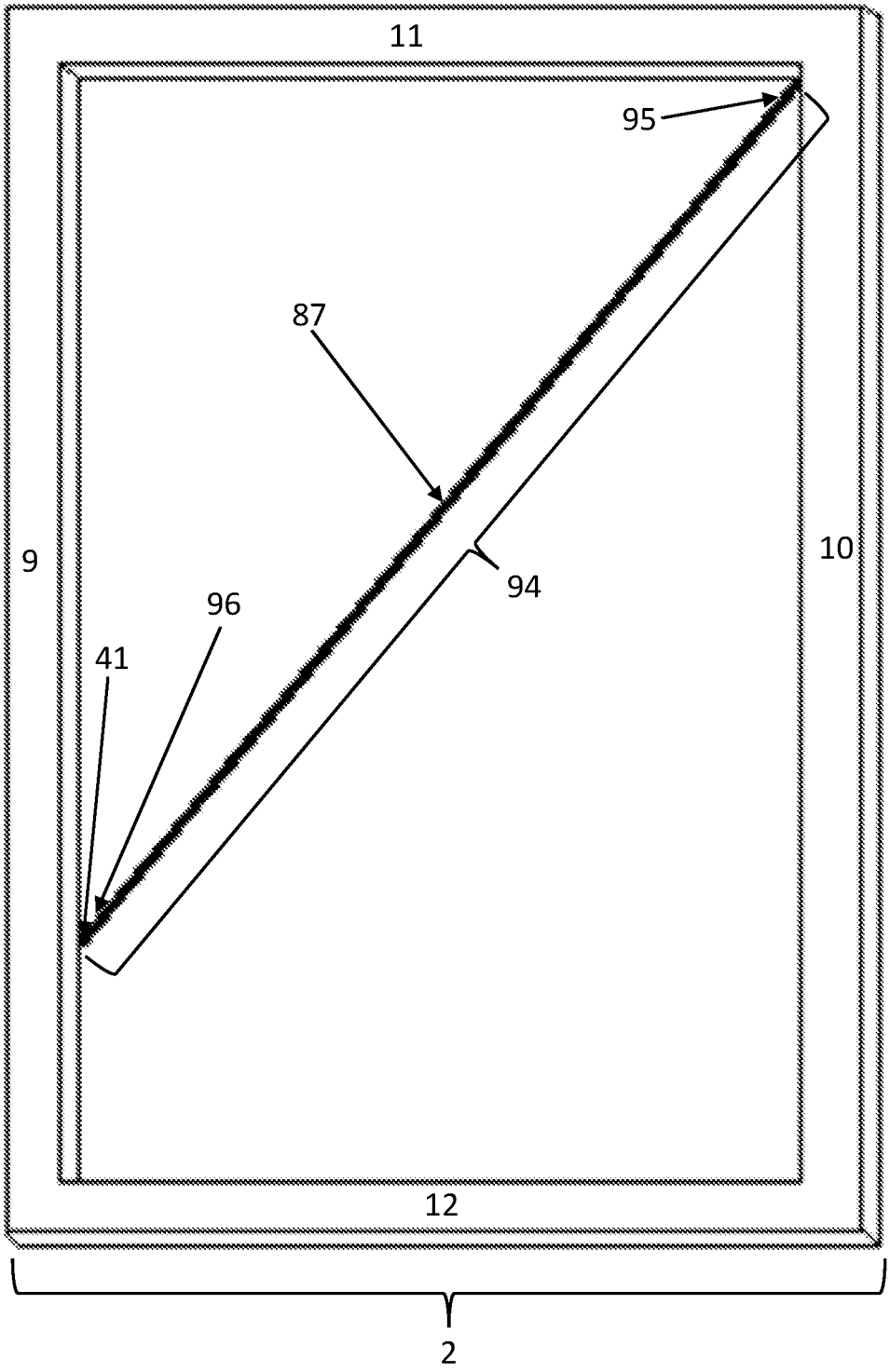
Figure 9:
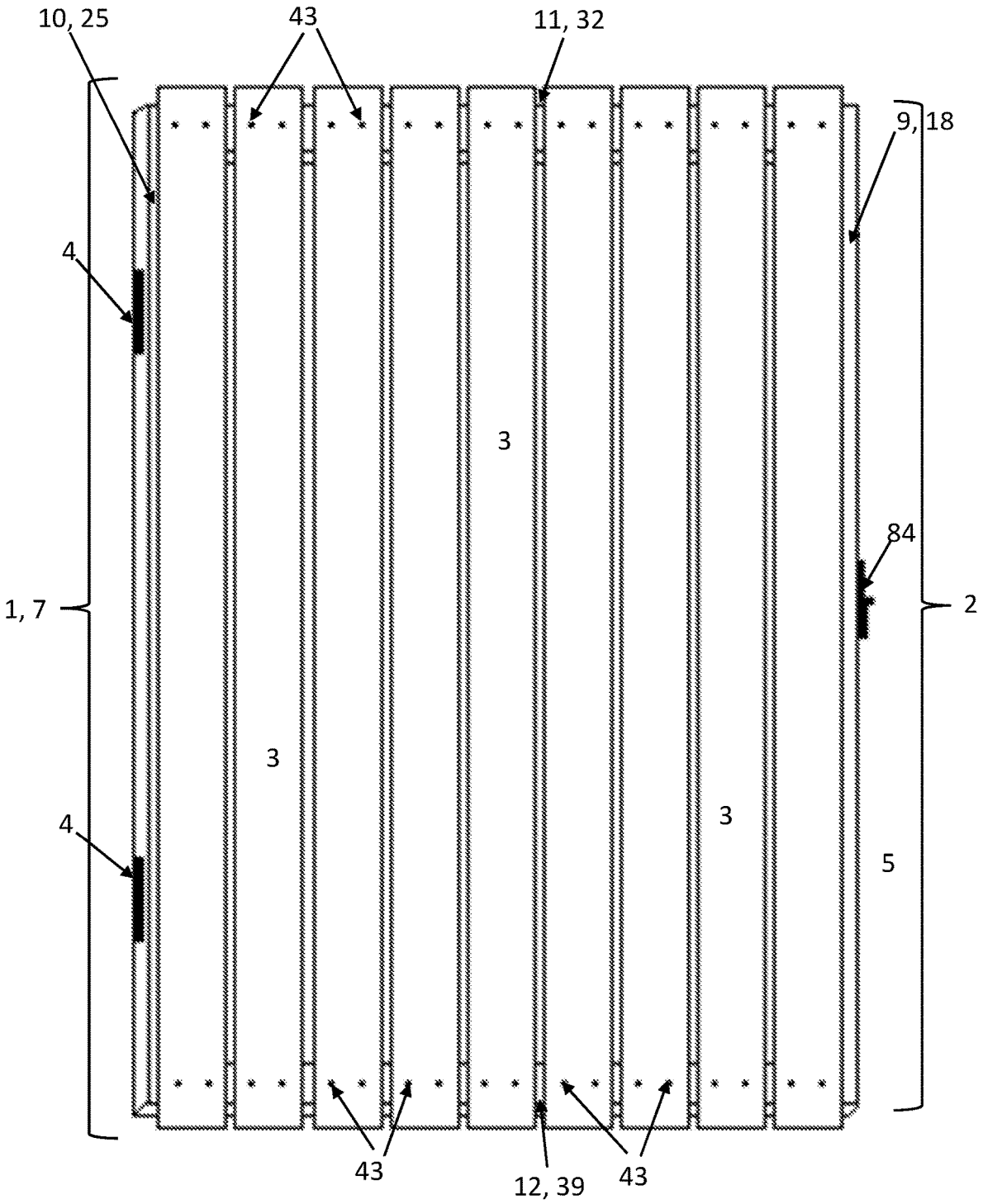
FIG. 9 is a view of the grate and framework with a plurality of slats, the latch, and the plurality of hinges.

The present disclosure reveals a gate 1 for fences comprising a framework 2, a plurality of slats 3, and a plurality of hinges 4. In the plurality of slats 3, each slat 3 may be made from wood, metal laminate, or mesh and wherein a plurality of slats 3 means at least one slat 3. The framework 2 is a light weight framework 2 made from rectangular tubular material wherein the walls of the rectangular tubular material is thin enough so that a self-tapping screw can be drilled into any wall of the rectangular tubular material in a fashion common to the industry. The gate 1 is being presented in four different embodiments.

The basic structure for the gate 1 comprises a left side 5, a right side 6, a front 7, and a back 8. The framework 2 comprises a left rectangular tubing 9, a right rectangular tubing 10, a top rectangular tubing 11, a bottom rectangular tubing 12. The left rectangular tubing 9 comprises a length 13, an upper end 14, a lower end 15, an outside face 16, an inside face 17, a front face 18, and a back face 19. The right rectangular tubing 10 comprises a length 20, an upper end 21, a lower end 22, an outside face 23, an inside face 24, a front face 25, and a back face 26. The top rectangular tubing 11 comprises a length 27, a left end 28, a right end 29, a top face 30, a bottom face 31, a front face 32, and a back face 33. The bottom rectangular tubing 12 comprises a length 34, a left end 35, a right end 36, a top face 37, a bottom face 38, a front face 39, and a back face 40. The elements of the framework 2 are held together by a plurality of mechanisms, wherein possible mechanisms include but are not limited to welds, rivets, or threaded fasteners and wherein a plurality of mechanisms includes one or more mechanisms.

The upper end 14 of the left rectangular tubing 9 is attached to the left end 28 of the top rectangular tubing 11 by a mechanism 41. In each case of the mechanism of the plurality of mechanisms 41, and for any mechanism 41, of the plurality of mechanisms the mechanism 41 includes welds, bolting, the use of threaded fasteners, and/or an adhesive. The upper end 21 of the right rectangular tubing 10 is attached to the right end 29 of the top rectangular tubing 11 by the mechanism of the plurality of mechanisms 41. The lower end 15 of the left rectangular tubing 9 is attached to the left end 35 of the bottom rectangular tubing 12 by the mechanism of the plurality of mechanisms 41. The lower end 22 of the right rectangular tubing 10 is attached to the right end 36 of the bottom rectangular tubing 12 by the mechanism of the plurality of mechanisms 41.

In the first embodiment 42, the gate 1 comprises a framework 2, a plurality of slats 3, and a plurality of hinges 4, wherein the plurality of hinges 4 are attached along the length 13/20, of the outside face 16/23 of at least one of the left rectangular tubing 9 or the right rectangular tubing 10, and the plurality of slats 3 are attached to the front side of the gate 1 at least one of horizontally, vertically, or diagonally by a plurality of attachments 43. The for any instance of the plurality of attachments, the plurality of attachments 43 includes but is not limited to threaded fasteners, rivets, bolts, and/or adhesive.

In the first embodiment 42, the framework 2 may further comprise an upper left rectangular tubing 44, an upper right rectangular tubing 45, a lower left rectangular tubing 46, and a lower right rectangular tubing 47. The upper left rectangular tubing 44 comprises a length 48, an upper end 49, and a lower end 50. The upper right rectangular tubing 45 comprises a length 51, an upper end 52, and a lower end 53. The lower left rectangular tubing 46 comprises a length 54, an upper end 55, and a lower end 56. The lower right rectangular tubing 47 comprises a length 57, an upper end 58, and a lower end 59. The upper end 49 of the upper left rectangular tubing 44 is attached to the top rectangular tubing 11 on the bottom face 31 along the length 27 of the top rectangular tubing 11 by the mechanism of the plurality of mechanisms 41 and the lower end 50 of the upper left rectangular tubing 44 is attached to the left rectangular tubing 9 on the inside face 17 along the length 13 of the left rectangular tubing 9 by the mechanism of the plurality of mechanisms 41. The upper end 52 of the upper right rectangular tubing 45 is attached to the top rectangular tubing 11 on the bottom face 31 along the length 27 of the top rectangular tubing 11 by the mechanism of the plurality of mechanisms 41 and the lower end 53 of the upper right rectangular tubing 45 is attached to the right rectangular tubing 10 on the inside face 24 along the length 20 of the right rectangular tubing 10 by the mechanism of the plurality of mechanisms 41. The lower end 56 of the lower left rectangular tubing 46 is attached to the bottom rectangular tubing 12 on the top face 37 along the length 34 of the bottom rectangular tubing 12 by the mechanism of the plurality of mechanisms 41 and the upper end 55 of the lower left rectangular tubing 46 is attached to the left rectangular tubing 9 on the inside face 17 along the length 13 of the left rectangular tubing 9 by the mechanism of the plurality of mechanisms 41. The lower end 59 of the lower right rectangular tubing 47 is attached to the bottom rectangular tubing 12 on the top face 37 along the length 34 of the bottom rectangular tubing 12 by the mechanism of the plurality of mechanisms 41 and the upper end 58 of the lower right rectangular tubing 47 is attached to the right rectangular tubing 10 on the inside face 24 along the length 20 of the right rectangular tubing 10 by the mechanism of the plurality of mechanisms 41.

In the second embodiment 60 of the gate 1 the framework 2 is modified in that the top rectangular tubing 11 further comprises a plurality of slots 61 and the bottom rectangular tubing 12 further comprises at least one of a plurality of slots 62 or a trough 63. In this embodiment 60, the plurality of slats 3 are passed through the plurality of slots 61 in the top rectangular tubing 11 through to the bottom rectangular tubing 12 and are attached by a plurality of attachments 43.

In the third embodiment 64 of the gate 1 the framework 2 is modified in that the left rectangular tubing 9 further comprises a plurality of slots 65 and the right rectangular tubing 10 further comprises a plurality of slots 66. In this embodiment 64, the plurality of slats 3 are passed through the plurality of slots 65 in the left rectangular tubing 9 through to the plurality of slots 66 in the right rectangular tubing 10 and are attached by a plurality of attachments 43.

In the fourth embodiment 67 of the gate 1 the framework 2 is modified as follows: The left rectangular tubing 9 further comprises a plurality of slots 65; the right rectangular tubing 10 further comprises a plurality of slots 66; the top rectangular tubing 11 further comprises a plurality of slots 61; and the bottom rectangular tubing 12 further comprises at least one of a plurality of slots 62 or a trough 63. In this embodiment 67, the plurality of slats 3 are passed through the at least one of the plurality of slots 65 in the left rectangular tubing 9, the plurality of slots 66 in the right rectangular tubing 10, the plurality of slots 61 in the top rectangular tubing 11, and to the bottom rectangular tubing 12 so as to create a diagonal arrangement of the slats 3 and the slats 3 are attached by a plurality of attachments 43.

In the second 60, third 64, and fourth embodiments 67 there may also be a plurality of upper left braces 68, a plurality of upper right braces 69, a plurality of lower left braces 70, and a plurality of lower right braces 71. The plurality of upper left braces 68 is defined as at least one brace. The plurality of upper right braces 69 is defined as at least one brace. The plurality of lower left braces 70 is defined as at least one brace. The plurality of lower right braces 71 is defined as at least one brace.

The plurality of upper left braces 68 each comprise a length 72, an upper end 73, and a lower end 74. The plurality of upper right braces 69 each comprise a length 75, an upper end 76, and a lower end 77. The plurality of lower left braces 70 each comprise a length 78, an upper end 79, and a lower end 80. The plurality of lower right braces 71 each comprise a length 81, an upper end 82, and a lower end 83.

The upper end 73 of the plurality of upper left braces 68 are attached to at least one of the front face 32 or the back face 33 of the top rectangular tubing 11 along the length 27 of the top rectangular 11 tubing by the mechanism of the plurality of mechanisms 41 and the lower end 74 of the plurality of upper left braces 68 are attached to at least one of the front face 18 or the back face 19 of the left rectangular tubing 9 along the length 13 of the left rectangular tubing 9 by the mechanism of the plurality of mechanisms 41. The upper end 76 of the plurality of upper right braces 69 are attached to at least one of the front face 32 or the back face 33 of the top rectangular tubing 11 along the length 27 of the top rectangular tubing 11 by the mechanism of the plurality of mechanisms 41 and the lower end 77 of the plurality of upper right rectangular 69 braces are attached to at least one of the front face 25 or the back face 26 of the right rectangular tubing 10 along the length 20 of the right rectangular tubing 10 by the mechanism of the plurality of mechanisms 41. The upper end 79 of the plurality of lower left braces 70 are attached to at least one of the front face 39 or the back face 40 of the bottom rectangular tubing 12 along the length 34 of the bottom rectangular tubing 12 by the mechanism of the plurality of mechanisms 41 and the lower end 80 of the plurality of lower left braces 70 are attached to at least one of the front face 18 or the back face 19 of the left rectangular tubing 9 along the length 13 of the left rectangular tubing 9 by the mechanism of the plurality of mechanisms 41. The upper end 82 of the plurality of lower right braces 71 are attached to at least one of the front face 39 or the back face 40 of the bottom rectangular tubing 12 along the length 34 of the bottom rectangular tubing 12 by the mechanism of the plurality of mechanisms 41 and the lower end 83 of the plurality of lower right braces 71 are attached to at least one of the front face 25 or the back face 26 of the right rectangular tubing 10 along the length 20 of the right rectangular tubing 10 by the mechanism of the plurality of mechanisms 41.

In any of the embodiments 42, 60, 64, 67, the gate 1 may further comprise a latch 84, said latch 84 attached along the length 13/20 of the outside face 16/23 of at least one of the left rectangular tubing 9 or the right rectangular tubing 10, wherein the latch 84 is attached on either the left rectangular tubing 9 or right rectangular tubing 10 opposite the hinges 4.

In any of the embodiments 42, 60, 64, 67, framework 2 may further comprise at least one of a plurality of vertical supports 85, a plurality of horizontal supports 86, and/or a plurality of diagonal supports 87. The plurality of vertical supports 85 means at least one vertical support 85. The plurality of horizontal supports 86 means at least one horizontal support 86. The plurality of diagonal 87 supports means at least one diagonal support 87. Each vertical support 85 of the plurality of vertical supports 85 comprises a length 88, a first end 89, and a second end 90, and the first end and the second end are attached to the framework 2 with the mechanism of the plurality of mechanisms 41. Each horizontal support 86 of the plurality of horizontal supports 86 comprises a length 91, a first end 92, and a second end 93, and the first end and the second end are attached to the framework 2 with the mechanism of the plurality of mechanisms 41. Each diagonal support 87 of the plurality of diagonal supports 87 comprises a length 94, a first end 95, and a second end 96, and the first end and the second end are attached to the framework 2 with the mechanism of the plurality of mechanisms 41.

What is claimed:

1. A gate for a fence, said gate consisting of:

the gate;

the gate further consisting of a framework, a plurality of slats, a plurality of hinges, a plurality of mechanisms to connect the framework together, wherein a mechanism of the plurality of mechanisms include at least one of welds, rivets, or threaded fasteners, a plurality of attachments to connect the plurality of slats to the framework, a latch, an upper left rectangular tubing, an upper right rectangular tubing, a lower left rectangular tubing, and a lower right rectangular tubing;

the framework with a left side, a right side, a front, and a back;

the framework further with a left rectangular tubing, a right rectangular tubing, a top rectangular tubing, a bottom rectangular tubing;

the left rectangular tubing with a length, an upper end, a lower end, an outside face, an inside face, a front face, and a back face;

the right rectangular tubing with a length, an upper end, a lower end, an outside face, an inside face, a front face and a back face;

the top rectangular tubing with a length, a left end, a right end, a top face, a bottom face, a front face, and a back face;

the bottom rectangular tubing with a length, a left end, a right end, a top face, a bottom face, a front face and a back face;

the upper end of the left rectangular tubing is attached to the left end of the top rectangular tubing by the mechanism of the plurality of mechanisms;

the upper end of the right rectangular tubing is attached to the right end of the top rectangular tubing by the mechanism of the plurality of mechanisms;

the lower end of the left rectangular tubing is attached to the left end of the bottom rectangular tubing by the mechanism of the plurality of mechanisms;

the lower end of the right rectangular tubing is attached to the right end of the bottom rectangular tubing by the mechanism of the plurality of mechanisms;

the plurality of hinges are attached along the length of the outside face of at least one of the left rectangular tubing or the right rectangular tubing;

the plurality of slats are attached to a front side of the framework in at least one of the following fashions, those fashions being horizontally, vertically, or diagonally, with the plurality of slats attached by the plurality of attachments;

wherein the latch is attached along the length of the outside face of at least one of the left rectangular tubing or the right rectangular tubing, wherein the latch is attached on either the left rectangular tubing or the right rectangular tubing opposite the hinges;

the upper left rectangular tubing consists of a length, an upper end, and a lower end;

the upper right rectangular tubing consists of a length, an upper end, and a lower end;

the lower left rectangular tubing consists of a length, an upper end, and a lower end;

the lower right rectangular tubing consists of a length, an upper end, and a lower end;

the upper end of the upper left rectangular tubing is attached to the top rectangular tubing on the bottom face thereof along the length of the top rectangular tubing by the mechanism of the plurality of mechanisms and the lower end of the upper left rectangular tubing is attached to the left rectangular tubing on the inside face thereof along the length of the left rectangular tubing by the mechanism of the plurality of mechanisms;

the upper end of the upper right rectangular tubing is attached to the top rectangular tubing on the bottom face thereof along the length of the top rectangular tubing by the mechanism of the plurality of mechanisms and the lower end of the upper right rectangular tubing is attached to the right rectangular tubing on the inside face thereof along the length of the right rectangular tubing by the mechanism of the plurality of mechanisms;

the lower end of the lower left rectangular tubing is attached to the bottom rectangular tubing on the top face thereof along the length of the bottom rectangular tubing by the mechanism of the plurality of mechanisms and the upper end of the lower left rectangular tubing is attached to the left rectangular tubing on the inside face thereof along the length of the left rectangular tubing by the mechanism of the plurality of mechanisms; and the lower end of the lower right rectangular tubing is attached to the bottom rectangular tubing on the top face thereof along the length of the bottom rectangular tubing by the mechanism of the plurality of mechanisms and the upper end of the lower right rectangular tubing is attached to the right rectangular tubing on the inside face thereof along the length of the right rectangular tubing by the mechanism of the plurality of mechanisms.

2. A gate for a fence, said gate consisting of:

the gate;

the gate consisting of a framework, a plurality of slats, a plurality of hinges, a plurality of mechanisms to connect the framework together, wherein a mechanism of the plurality of mechanisms include at least one of welds, rivets, or threaded fasteners, a plurality of attachments to connect the plurality of slats to the framework, a latch, an upper left rectangular tubing, an upper right rectangular tubing, a lower left rectangular tubing, a lower right rectangular tubing, and at least one of a plurality of vertical supports, a plurality of horizontal supports, or a plurality of diagonal supports;

the framework with a left side, a right side, a front, and a back;

the framework further with a left rectangular tubing, a right rectangular tubing, a top rectangular tubing, a bottom rectangular tubing;

the left rectangular tubing with a length, an upper end, a lower end, an outside face, an inside face, a front face, and a back face;

the right rectangular tubing with a length, an upper end, a lower end, an outside face, an inside face, a front face and a back face;

the top rectangular tubing with a length, a left end, a right end, a top face, a bottom face, a front face, and a back face;

the bottom rectangular tubing with a length, a left end, a right end, a top face, a bottom face, a front face and a back face;

the upper end of the left rectangular tubing is attached to the left end of the top rectangular tubing by the mechanism of the plurality of mechanisms;

the upper end of the right rectangular tubing is attached to the right end of the top rectangular tubing by the mechanism of the plurality of mechanisms;

the lower end of the left rectangular tubing is attached to the left end of the bottom rectangular tubing by the mechanism of the plurality of mechanisms;

the lower end of the right rectangular tubing is attached to the right end of the bottom rectangular tubing by the mechanism of the plurality of mechanisms;

the plurality of hinges are attached along the length of the outside face of at least one of the left rectangular tubing or the right rectangular tubing;

the plurality of slats are attached to a front side of the framework in at least one of the following fashions, those fashions being horizontally, vertically, or diagonally, with the plurality of slats attached by the plurality of attachments;

wherein the latch is attached along the length of the outside face of at least one of the left rectangular tubing or the right rectangular tubing, wherein the latch is attached on either the left rectangular tubing or the right rectangular tubing opposite the hinges;

the upper left rectangular tubing consists of a length, an upper end, and a lower end;

the upper right rectangular tubing consists of a length, an upper end, and a lower end;

the lower left rectangular tubing consists of a length, an upper end, and a lower end;

the lower right rectangular tubing consists of a length, an upper end, and a lower end;

the upper end of the upper left rectangular tubing is attached to the top rectangular tubing on the bottom face thereof along the length of the top rectangular tubing by the mechanism of the plurality of mechanisms and the lower end of the upper left rectangular tubing is attached to the left rectangular tubing on the inside face thereof along the length of the left rectangular tubing by the mechanism of the plurality of mechanisms;

the upper end of the upper right rectangular tubing is attached to the top rectangular tubing on the bottom face thereof along the length of the top rectangular tubing by the mechanism of the plurality of mechanisms and the lower end of the upper right rectangular tubing is attached to the right rectangular tubing on the inside face thereof along the length of the right rectangular tubing by the mechanism of the plurality of mechanisms;

the lower end of the lower left rectangular tubing is attached to the bottom rectangular tubing on the top face thereof along the length of the bottom rectangular tubing by the mechanism of the plurality of mechanisms and the upper end of the lower left rectangular tubing is attached to the left rectangular tubing on the inside face thereof along the length of the left rectangular tubing by the mechanism of the plurality of mechanisms;

the lower end of the lower right rectangular tubing is attached to the bottom rectangular tubing on the top face thereof along the length of the bottom rectangular tubing by the mechanism of the plurality of mechanisms and the upper end of the lower right rectangular tubing is attached to the right rectangular tubing on the inside face thereof along the length of the right rectangular tubing by the mechanism of the plurality of mechanisms;

each vertical support of the plurality of vertical supports consists of a length, a first end, and a second end, wherein the first end of each vertical support is attached to the framework by the mechanism of the plurality of mechanisms and the second end of each vertical support is attached to the framework with the mechanism of the plurality of mechanisms;

each horizontal support of the plurality of horizontal supports consists of a length, a first end, and a second end, wherein the first end of each horizontal support is attached to the framework with the mechanism of the plurality of mechanisms and the second end of each horizontal support is attached to the framework with the mechanism of the plurality of mechanisms; and each diagonal support of the plurality of diagonal supports consists of a length, a first end, and a second end, wherein the first end of each diagonal support is attached to the framework with the mechanism of the plurality of mechanisms and the second end of each diagonal support is attached to the framework with the mechanism of the plurality of mechanisms.

* * * * *